US006253538B1

(12) United States Patent
Sampath et al.

(10) Patent No.: US 6,253,538 B1
(45) Date of Patent: Jul. 3, 2001

(54) VARIABLE PREMIX-LEAN BURN COMBUSTOR

(75) Inventors: Parthasarathy Sampath, Mississauga; Nigel Caldwell Davenport, Hillsburgh, both of (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/404,994

(22) Filed: Sep. 27, 1999

(51) Int. Cl.[7] ..... F23R 3/22; F23R 3/30
(52) U.S. Cl. ..... 60/39.06; 60/39.23; 60/737
(58) Field of Search ..... 60/39.06, 39.23, 60/737, 738

(56) References Cited

U.S. PATENT DOCUMENTS

| | | | | |
|---|---|---|---|---|
| 3,605,405 | | 9/1971 | Du Bell et al. . | |
| 3,667,221 | | 6/1972 | Taylor . | |
| 3,905,192 | | 9/1975 | Pierce et al. . | |
| 3,952,501 | | 4/1976 | Saintsbury . | |
| 4,138,842 | * | 2/1979 | Zwick | 60/39.23 |
| 4,255,927 | | 3/1981 | Johnson et al. . | |
| 4,497,170 | | 2/1985 | Elliott et al. . | |
| 4,884,746 | | 12/1989 | Lewis . | |
| 5,247,797 | | 9/1993 | Fric et al. . | |
| 5,477,671 | | 12/1995 | Mowill . | |
| 5,481,866 | | 1/1996 | Mowill . | |
| 5,572,862 | | 11/1996 | Mowill . | |
| 5,611,684 | | 3/1997 | Spielman . | |
| 5,613,357 | | 3/1997 | Mowill . | |
| 5,628,182 | | 5/1997 | Mowill . | |
| 5,918,459 | * | 7/1999 | Nakae | 60/39.23 |
| 6,070,406 | * | 6/2000 | Lenertz et al. | 60/39.23 |

FOREIGN PATENT DOCUMENTS 57-192728 11/1982 (JP) .

* cited by examiner

*Primary Examiner*—Louis J. Casaregola
(74) *Attorney, Agent, or Firm*—Jeffrey W. Astle

(57) ABSTRACT

A method and device are provided to enable optimizing combustion conditions of a continuous combustion device to produce low emissions of nitric oxide, carbon monoxide and hydrocarbons at all operative conditions. The continuous combustion device includes a slidable baffle to regulate, according to power levels, not only an airflow directly into a primary combustion zone and a secondary combustion zone but also an airflow into a fuel/air premix device to maintain the fuel/air ratio in the primary combustion zone optimized both at an average level and in local areas. Such that, low objectionate or harmful emissions can be reached without performance penalties of the combustion device, such as anti-ignition, flashback or flameout.

11 Claims, 2 Drawing Sheets

VARIABLE PREMIX-LEAN BURN COMBUSTOR

TECHNICAL FIELD

This invention relates to a continuous combustion device, particularly, to the controlled formation of objectionable or harmful exhaust emissions from a gas turbine engine combustor, in an effort to maintain the objectionable or harmful exhaust emissions at an acceptable level.

BACKGROUND OF THE INVENTION

A continuous combustion device usually has a primary combustion zone and a secondary combustion zone. Ideally, from a combustion or pollution aspect, or both, the primary combustion zone fuel/air ratio should be kept as close as possible to an optimum value which may be constant over the operating range of the combustion device. This does not normally happen. A gas turbine engine used as a propulsion unit on an aircraft, for example, will operate in varying operative conditions for different thrust settings. When an aircraft is on the ground, the thrust setting is relatively low to permit stopping or taxiing. When the aircraft initiates a take-off, the thrust is typically increased to its maximum setting until the aircraft reaches a cruising altitude and then is tapered back to an intermediate setting for a normal cruising flight. However, the fixed geometry of the conventional continuous combustion device provides a range of primary combustion zone fuel/air ratios which can go from over-rich to over-lean when the operative conditions vary.

It is well-known that the constituent emissions from a combustion device exhaust are formed by diverse processes depending on different, or even opposite, conditions, and therefore, problems are experienced when attempts are made to compensate for the variations in the operative conditions of the continuous combustion device. For example, the nitric oxide formation rate depends essentially on the temperature in the primary combustion zone and the availability of dissociated or free oxygen. A early or accelerated admission of cooling or dilution air to the primary zone can quench the reaction and restrict nitric oxide formation to low levels. This procedure may, however, increase hydrocarbons, smoke and carbon monoxide formation due to incomplete combustion.

In a conventional continuous combustion device used in a gas turbine engine at full load, carbon monoxide and hydrocarbons are practically non-existent, whereas nitric oxide emissions are at their peak. A continuous combustion device optimized for full load pollutant emissions would have a leaner than normal primary zone fuel/air ratio, and its yield in hydrocarbons and carbon monoxide would be higher, whereas nitric oxides would be considerably reduced, such a combustion device would not be practical for a normal application in a gas turbine engine where the fuel/air ratio is varied over a wide range, especially its stability would be poor and the emissions of hydrocarbons and carbon monoxide emissions would be very high when the engine is idling.

To maintain those objectionable or harmful exhaust emissions from a gas turbine engine combustor at an acceptable level, prior art combustion devices have provided means for varying the distribution of air flow within a combustor and means for providing automization, premixing and substantial vaporization to maintain the primary combustion zone fuel/air ratio within a narrow range when the operative conditions vary. One example of reducing harmful emissions in all modes of engine operations is described in U.S. Pat. No. 3,952,501, entitled GAS TURBINE CONTROL, naming John A. Saintsbury as inventor and issued Apr. 27, 1976. Saintsbury suggests a longitudinally adjustable baffle that is used to control the direction of air flow into the combustor to effect a substantially optimum proportionate distribution of combustion air throughout the combustor at all power levels. The fraction of primary zone airflow will be gradually reduced as the power is decreased, holding the fuel/air substantially to the predetermined optimum value. This procedure reduces the production of carbon monoxide and unburned hydrocarbons at low power because combustion takes place at a more favourable fuel/air ratio. The nitric oxide production is inherently low at reduced power because of the lower temperature of inlet air to the combustor. Moreover, more cooling air is diverted into the secondary zone, whereby the hot gases could be more efficiently cooled.

The nitric oxide produced in gas turbine engines is produced in the combustion process where the highest temperature in the cycle normally exists. Therefore, one way to limit the amount of nitric oxide produced is to limit the combustion temperature. Experience has shown that it is not enough to just limit the average temperature because when fuel is burned as drops of liquid or a diffusion gas flame, the combustion proceeds at near the stoichiometric value and the local temperature is very high, thus producing excessive nitric oxide. To produce the lowest possible nitric oxide, thoroughly premixing all of the fuel and combustion air in a mixing chamber separate from the combustion chamber itself is suggested in U.S. Pat. No. 5,477,671, entitled SINGLE STAGE PRE-MIXED CONSTANT FUEL/AIR RATIO COMBUSTOR and issued to Mowill on Dec. 26, 1995. Mowill describes in his patent, a compressed air valve and a fuel valve both under the control of a controller, to provide a preselected lean fuel/air ratio mixture for introduction to the combustion zone of an annular housing. Compressed air conduits are used to channel a portion of the total compressed air flow to a premixer and the remainder to a dilution zone of the combustor, and a fuel conduit is used to deliver all of the fuel to the premixer.

Another example is described in U.S. Pat. No. 3,905,192, entitled COMBUSTOR HAVING STAGED PRE-MIXING TUBES and issued to Pierce et al. on Sep. 16, 1975. Pierce et al. describe, in this patent, a gas turbine engine having an annular combustor with a plurality of staged premixing tubes extending from the forward end thereof. Each tube directs a flow to the combustor through two concentric flow passages. A moveable tube section is arranged to direct all of the air through both flow passages or just through one passage. Fuel is directed into the staged premixing tube for mixing with air generally flowing through the central flow passage. Swirler vanes are provided in each of the flow passages to provide for rotation of air passing therethrough. The air flow proportion through the two concentric flow passages can be varied by the moveable tube section and, therefore, the fuel/air premixing ratio is adjusted.

However, since the proportion of air entering through the outer flow passage into the primary zone decreases as the proportion of air entering through the central flow passage into the primary zone in a premixed condition increases, the total amount of air reaching the primary zone through the both flow passages cannot be significantly regulated and, in fact, finally affects the improvement of the combustion conditions in the primary combustion zone.

SUMMARY OF THE INVENTION

It is an object of the invention to provide a continuous combustion device which results in low objectionable or harmful emissions.

It is another object of the invention to provide a variable premix device for a continuous annular combustor for optimizing combustion conditions.

It is a further object of the invention to provide continuous combustion device which has a baffle means to control a variable airflow to a fuel/air premix device, primary zone and secondary zone of a combustor respectively over an operation range of the continuous combustion device.

In general terms, the invention is to provide a method and device which enable optimizing combustion conditions of a continuous combustion device to produce low emissions of nitric oxide, carbon monoxide and hydrocarbon at all operative conditions by varying not only a premixing fuel/air ratio but also an airflow directly and respectively entering into a primary combustion zone and a secondary combustion zone using a single baffle means to match varying load conditions.

In specific terms, a continuous combustion device comprises an elongated combustion chamber having an outer wall, means defining an air passage co-extensive with at least the combustion chamber outer wall, at least one fuel/air premix device for mixing fuel with a portion of air introduced from the air passage through a conduit between the air passage and the premix device, a fuel injector for feeding the premixed fuel/air mixture into the combustion chamber, a primary combustion zone defined within a section of the combustion cheer near the fuel injector, a secondary combustion zone defined adjacent the primary zone, first air inlets in the outer wall in the area of the primary zone, second air inlets in the outer wall in the area of the secondary zone, baffle means for distributing an airflow to the respective premix device, the primary and secondary combustion zones slidably mounted in a joint area of the air passage and the conduit, and the joint area being between the primary zone and the secondary zone, the baffle means being slidable between a first position where air passes relatively unimpeded through the first inlets to the primary zone, through the second air inlets to the secondary zone and through the conduit to the premix device, and a second position where a larger portion of the air is deflected to the secondary zone and less to the primary zone and the premix device whereby a total amount of air entering the primary combustion zone both directly and through the premix device is in substantially stoichiometric proportion to fuel fed into the combustion chamber.

In the continuous combustion device according to the invention, regulation is such that most of the air fed to the combustion does not reach the fuel/air premix device or directly enter into the primary combustion zone. The result is that a richer, easier-to-ignite fuel/air mixture is provided in the primary combustion zone which burns relatively better, and thus the burnt gases have a lower carbon monoxide and hydrocarbon content. As the fuel flow is increased, the air flow may be proportionally adjusted to increase the portion of air flowing directly into the primary zone and the premix device. In a similar manner, combustion stability is assured on deceleration from high power conditions due to the regulated increase in fuel/air ratio.

The amount of air reaching to the primary zone both directly and through the premix device as the premixed fuel/air mixture effects the final fuel/air ratio in the primary zone and combustion conditions therein. Because the airflow to the premix device is regulated simultaneously with the airflow directly into the primary zone, the combustion conditions in the primary combustion zone is improved not only at an average level but also in local areas and, therefore, lower objectionable or harmful emissions can be resulted as compared to the combustion device described in Canadian patent 1,005,651, in which the fuel/air ratio in the primary zone is regulated only at an average level.

The invention advantageously enables optimizing combustion conditions to produce a very low nitric oxide, carbon monoxide and hydrocarbon content in emissions at all operative conditions of the combustion device without any performance penalties, such as anti-ignition, flashback or flameout. Other advantages and features will be clearly understood from a preferred embodiment of the invention.

BRIEF DESCRIPTION OF THE DRAWINGS

The invention will now be further explained by way of example only and with reference to the following drawings, in which.

DETAILED DESCRIPTION OF THE PREFERRED EMBODIMENT

Figure 1:
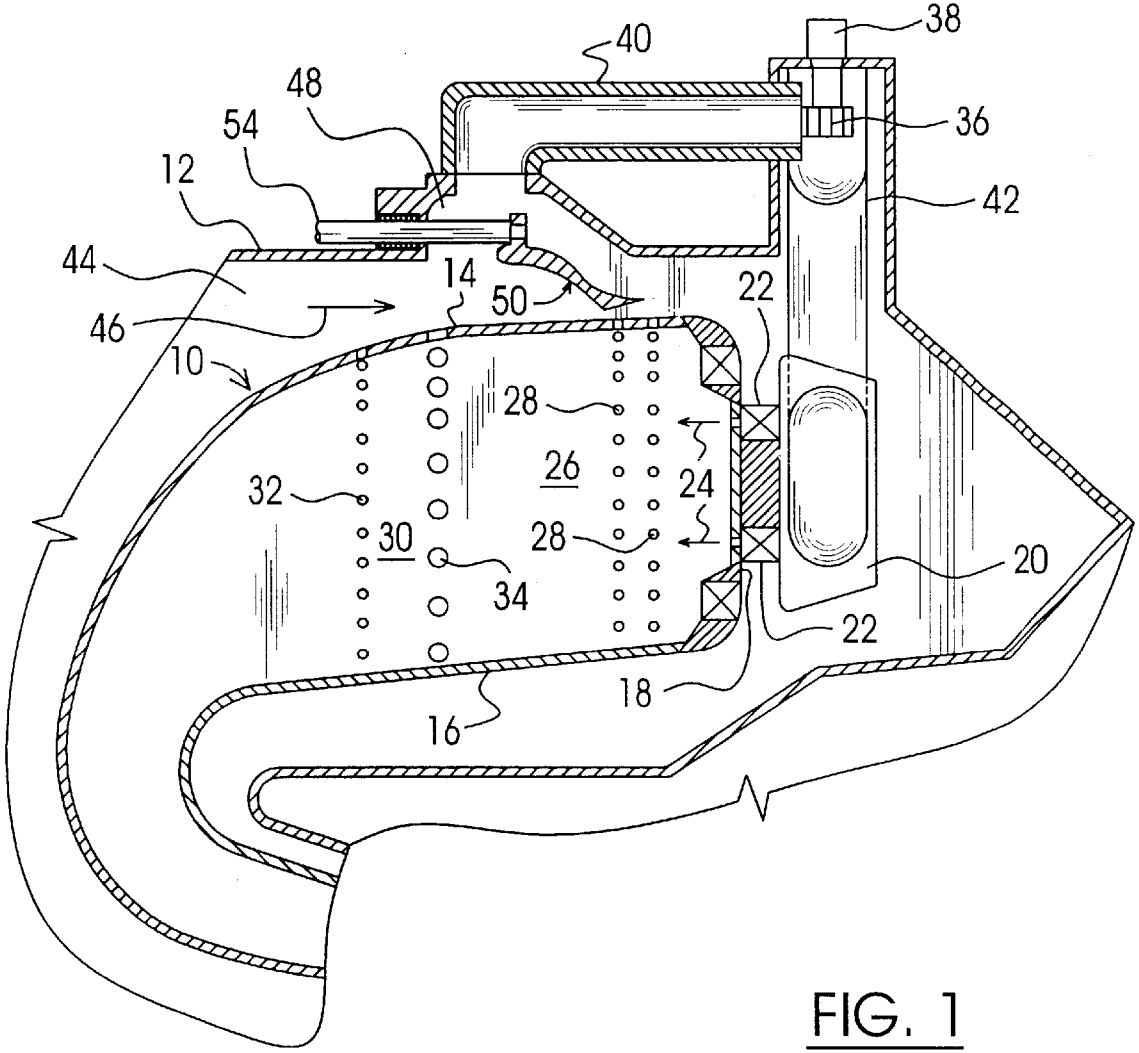
FIG. 1 is a schematic view of a fragmentary radial cross-section taken through a typical annular type combustion chamber incorporating a preferred embodiment of the invention.

FIG. 1 illustrates a reverse flow annular type of combustion chamber 10 which extends concentrically with a outer cylindrical engine casing 12.

The combustion chamber 10 includes concentric outer and inner walls 14 and 16, respectively. The combustion chamber terminates at one end in an annular end wall 18. An annular distributor bulkhead 20 is mounted to the outside of the annular end wall 18, concentrically with the annular combustion chamber 10 for distributing a fuel/air mixture to the combustion chamber 10. The distributor bulkhead 20 includes a plurality of swizzler nozzles 22 through which the fuel/air mixture received in the distributor bulkhead 20 is widely injected, indicated by the arrows 24, into a section of the combustion chamber 10 near the annular end wall 18, which forms a primary combustion zone 26. A plurality of holes 28 are provided in outer wall 14 of the combustion chamber 10 at the primary combustion zone 26 to permit an airflow directly to enter into the primary zone 26. Adjacent to the primary combustion zone 26, a secondary combustion zone 30 can be defined, and a plurality of apertures 32 may be provided as well as enlarged apertures 34. The apertures 32, 34 allow for greater volume of dilution air to enter into the secondary zone 30.

Four or more fuel/air premix devices 36, equally spaced-apart circumferentially around the annular combustion chamber 10 at the end are supported by the outer casing 12, and only one is shown. The premix device 36 is connected through a pipeline 38 to a fuel source for intake of fuel and through a conduit 40 with an air source for intake of air to permit fuel/air premixing upstream of the combustion chamber 10. Each premix device 36 is connected in fluid communication with a premix tube 42 in which the premix of fuel/air occurs and is to be distributed. The premix tubes 42 extend inwardly and radially towards the end of the annular combustion chamber 10 and are connected tangentially with the annular distributor bulkhead 20 in fluid communication so that the premixed fuel/air mixture flows into the distributor bulkhead 20 in a circular direction and is adapted to be evenly injected to the combustion chamber 10 by the swizzler nozzles 22.

The principle and structure of the premix device is well known in the art, such as described in U.S. Pat. No.

5,477,671 which is incorporated herein by reference and is not described in any further detail.

It will be understood by persons skilled in the art that the number of assemblies of the fuel/air premix device 36 and the premix tube 42 is not necessarily four but can vary. Nevertheless, the premix device and tube assemblies, if more than one, should be mounted to the annular end of the combustion chamber 10 equally spaced-apart to ensure a uniform entry of the premixed fuel/air mixture into the combustion chamber 10.

An annular air passage 44 is formed between the casing wall 12 and the outer wall 14 of the combustion chamber 10. The air entering into this area follows the direction of the arrow 46 and passes longitudinally through the annular passage 44.

An annular recessed portion 48 in the casing 12 is provided substantially between the primary and secondary combustion zones 26 and 30 in the combustion chamber 10. Each of the air conduits 40 is connected with the annular recessed portion 48 in fluid communication to form an air take-off from the annular air passage 44 for intake of a portion of air flowing in the annular air passage 44. An annular baffle 50 is provided in the annular recessed portion 48 and extends downwardly in the air passage 44, as shown.

Figure 2:
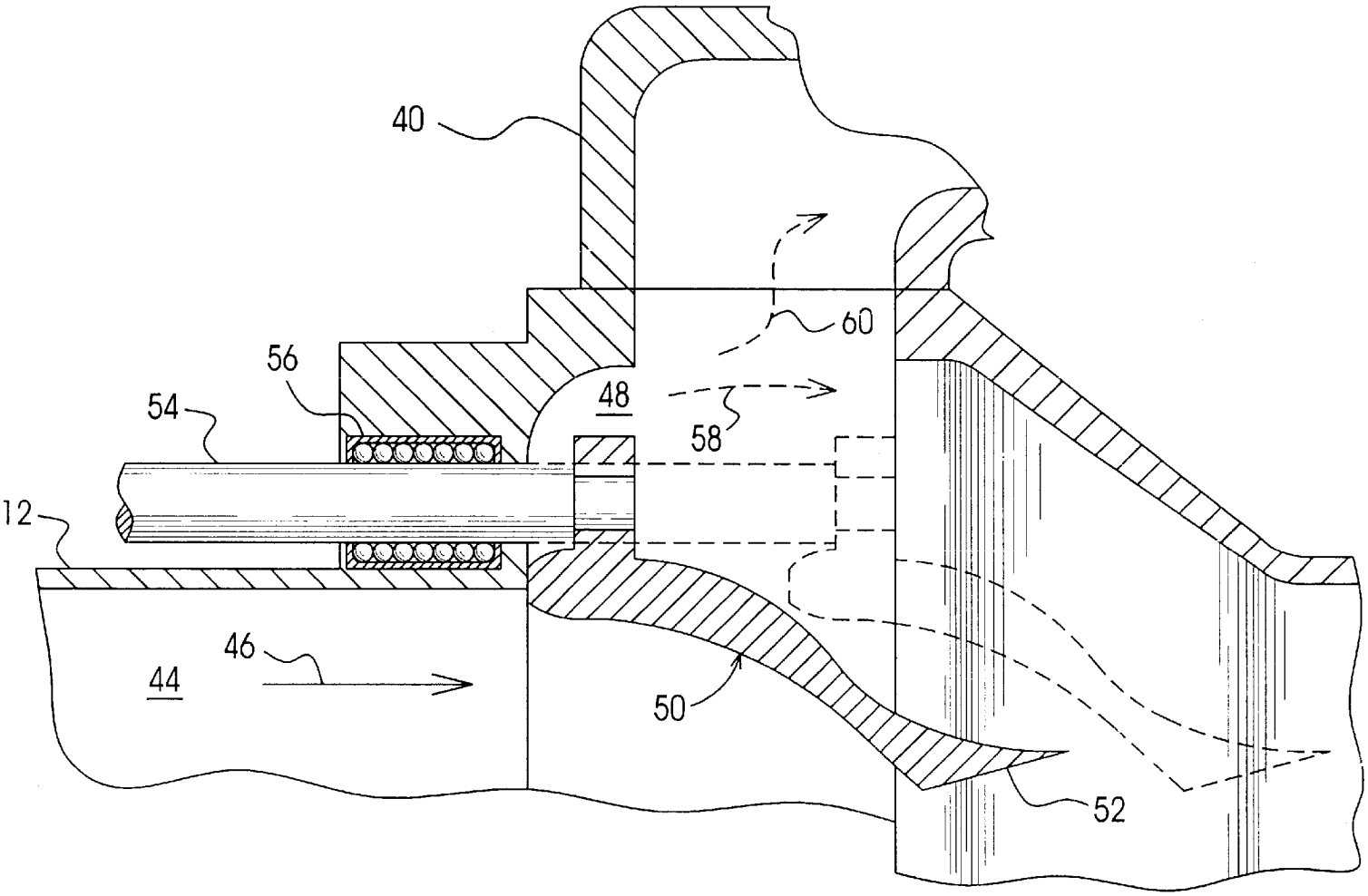
FIG. 2 is an enlarged, fragmentary view of a detail shown in FIG. 1.

FIG. 2 illustrates the annular baffle 50 in an enlarged scale with details. The annular baffle 50 is shaped to have certain airfoil characteristics and has a hammerhead shaped tip 52 which defines a lamination of the air flow as it leaves the baffle 50. The annular baffle 50 is mounted to a series of sliding control rods 54 which in turn slide in respect to a bearing housing 56 provided in the body of the casing 12.

The annular baffle 50 can be moved between a position shown in dotted lines, that is, midway relative to the recess 48 and to a position shown in full lines, that is, to the extreme left of the recess 48. When the annular baffle 50 is in the position shown in dotted lines, that is, midway of the recess 48, the airflow, following the direction of the arrow 46, is permitted to pass relatively unimpeded through the air passage 44 on both sides of the annular baffle 50. A dotted arrow 58 indicates an airflow passing on the outside of the annular baffle 50 and a dotted arrow 60 indicates a portion of the airflow which passes on the outside of the annular buffer 50 and enters into the air conduit 40. This general flow of air will reach both the secondary zone 30 and the primary combustion zone 26 as well as the fuel/air premix device 36 practically as if no baffle existed and as in conventional engines of this type, more clearly shown in FIG. 1.

Thus, if the fuel/air ratio is normally set for specific load conditions, the annular baffle 50 is maintained in this position. If the aircraft is on the ground and the engine is idling, such a fuel/air ratio would be unsuitable since the emissions of hydrocarbons and carbon monoxide would be to high. Accordingly, it has been found that it would be best to have a rich mixture in the primary zone, therefore creating a hotter burn in this primary zone and to divert more dilution air into the secondary zone, whereby the hot gases could be more efficiently cooled. In order to do this, the annular baffle 50 is moved towards the left in the drawings of FIGS. 1 and 2 by means of the sliding rods 54 which are connected to and are integral with the fuel control unit, not shown. As the annular buffer 50 reaches the extreme position shown in full lines in FIG. 2, it effectively blocks off most of the air passage 34 including the bypass formed by the annular recess 48, thereby diverting most of the air coming through the passage 44 into the secondary zone through the apertures 32 and 34. However, a small portion of air is permitted to pass on the inner side of the annular baffle 50 into the primary combustion zone 26 and the fuel/air premix device 36 to form a richer combustion condition in the combustion chamber 10. During take-off and when the aircraft is under load conditions, the annular baffle 50 is returned to its central position relative to the annular recess 48 permitting the air to pass unimpeded to both the primary zone and the secondary zone as well as the premix device 36 to provide a relatively lean combustion condition in the combustion chamber 10.

The combustion devices of the invention can be of different kinds, for example, straight through annular, reverse flow annular, can type or can annular type.

Modifications and improvements to the above-described embodiment of the invention may become apparent to those skilled in the art. The foregoing description is intended to be exemplary rather than limiting. The scope of the invention is therefore intended to be limited solely by the scope of the appended claims.

We claim:

1. A continuous combustion device comprising an elongated combustion chamber having an outer wall, means defining an air passage co-extensive with at least the combustion chamber outer wall, at least one fuel/air premix device for mixing fuel with a portion of air introduced from the air passage through a conduit between the air passage and the premix device, a fuel injector for feeding the premixed fuel/air mixture into the combustion chamber, a primary combustion zone defined within a section of the combustion chamber near the fuel injector, a secondary combustion zone defined adjacent the primary zone, first air inlets in the outer wall in the area of the primary zone, second air inlets in the outer wall in the area of the secondary zone, baffle means for distributing an airflow to the respective premix device, the primary and secondary combustion zones slidably mounted in a joint area of the air passage and the conduit and the joint area being between the primary zone and the secondary zone, the baffle means being slidable between a first position where air passes relatively unimpeded through the first air inlets to the primary zone, through the second inlets to the secondary zone and through the conduit to the premix device respectively, and a second position where a larger portion of the air is deflected to the secondary zone and less to the primary zone and the premix device, whereby a total amount of air entering the primary combustion zone both directly and through the premix device is in substantially stoichiometric proportion to fuel fed into the combustion chamber.

2. A continuous combustion device as defined in claim 1, wherein the air passage is enlarged in the area of the baffle means so that when the baffle means is in the first position, air can pass on both sides of the baffle means but when the baffle means is in the second position, the baffle means substantially blocks the enlarged area of the air path.

3. A continuous combustion device as claimed in claim 1 wherein the outer wall of the combustion chamber is cylindrical, and means defining the air passage with the outer wall is a concentric cylindrical casing, and an enlarged annulus is provided in the area between the primary zone and the secondary zone for connection to the conduit and accommodating the baffle means, and the baffle means is a continuous annular baffle provided for longitudinal sliding movement in the annulus between the first position central of the annulus permitting air to move substantially unimpeded directly into the primary zone and through the conduit to the premix device, and the second position abutting the casing and deflecting air to the secondary zone preventing most of the air from entering the annulus.

4. A continuous combustion device as claimed in claim 3 wherein the combustion chamber is an annular type combustion chamber with the air and gases within the combustion chamber moving generally in a direction-opposite to the air moving in the air passage.

5. A continuous combustion device as claimed in claim 2 wherein the baffle means has airfoil characteristics with an enlarged trailing tip converging in the trailing direction of the air flow so as to provide improved lamination of air flow when the baffle means is in a position permitting the air to pass on both sides of the baffle means.

6. A continuous combustion device as claimed in claim 1 wherein the premix device is connected to a fuel supply source and a premix tube in which the premix of fuel/air occurs.

7. A continuous combustion device as claimed in claim 6 wherein the fuel injector comprises a plurality of swirler nozzles for injecting the premixed fuel/air mixture into the primary zone of the combustion chamber, and a distributor in fluid communication with the premix tube and the swirler nozzles for distributing the premixed fuel/air mixture to the swirler nozzles.

8. A continuous combustion device as claimed in claim 4 wherein the premix device is connected to a fuel supply source and a premix tube in which the premix of the fuel/air occurs, the premix tube extending radially and angularly to an annular distributor that is included in the fuel injector for distributing the premixed fuel/air mixture.

9. A continuous combustion device as claimed in claim 4 comprising more than one fuel/air premix device equally spaced-apart and circumferentially around the annular combustion chamber, each premix device being connected with a fuel supply source for intake of fuel and through the conduit with the enlarged annulus of the air passage for intake of air, each premix device being connected in fluid communication with a premix tube in which the premix of the fuel/air occurs, the premix tube extending inwardly and radially towards an end of the annular combustion chamber and tangentially connected with an annular distributor, the annular distributor in fluid communication, including a plurality of swirler nozzles mounted to the end of the combustion chamber for injecting the premixed fuel/air mixture into the annular combustion chamber.

10. A method of regulating an airflow in a continuous combustion device for optimizing combustion conditions for minimum pollutants and maximum efficiency comprising: regulating a fuel/air ratio in a primary combustion zone of the combustion device using a single adjustable baffle in a joint area of air passages to a fuel/air premix device, a secondary combustion zone of the combustion device and the primary combustion zone respectively, to effect a substantially optimum proportionate distribution of an airflow to the fuel/air premix device, the primary combustion zone and the secondary combustion zone of the combustion device at all power levels the baffle being adjustable between a first position where air passes relatively unimpeded to the primary combustion zone, the secondary combustion zone and the premix device, and a second position where a larger portion of the air is deflected to the secondary combustion zone and less to the primary combustion zone and the premix device so that a total amount of air entering the primary combustion zone both directly or through the premix device is in substantially stoichiometric proportion to fuel fed into the primary combustion zone from the premix device.

11. A method as claimed in claim 10 wherein the airflow is distributed so that the airflow to the fuel/air premix device and the primary combustion zone both increase as the airflow to the secondary combustion zone decreases and the airflow to the fuel/air premix device and the primary combustion zone both decrease as the airflow to the secondary combustion zone increases.

* * * * *